US005653611A

United States Patent [19]

Shibata et al.

[11] Patent Number: 5,653,611

[45] Date of Patent: Aug. 5, 1997

[54] CONNECTOR CONNECTING DEVICE

[75] Inventors: Tomoyuki Shibata; Yoshimi Noro; Fusatomo Miyake, all of Aichi, Japan

[73] Assignee: Kabushiki Kaisha Tokai Rika Denki Seisakusho, Aichi, Japan

[21] Appl. No.: 527,010

[22] Filed: Sep. 12, 1995

[30] Foreign Application Priority Data

Sep. 13, 1994 [JP] Japan ..... 6-218455

[51] Int. Cl.[6] ..... H01R 13/405

[52] U.S. Cl. ..... 439/736

[58] Field of Search ..... 439/736, 660, 439/637, 722

[56] References Cited

U.S. PATENT DOCUMENTS 5,009,614 4/1991 Fogg et al. ..... 439/736
5,176,541 1/1993 Mori .

FOREIGN PATENT DOCUMENTS 0 519 709 A1 12/1992 European Pat. Off. .
364826 10/1960 Switzerland .

*Primary Examiner*—Neil Abrams
*Assistant Examiner*—Eugene G. Byrd
*Attorney, Agent, or Firm*—Finnegan, Henderson, Farabow, Garrett & Dunner, L.L.P.

[57] ABSTRACT

The connector connecting device includes: a connector receiving main-part that is molded with a row of connecting terminals after inserting the connecting terminals therein, has mold extracting holes respectively formed in an upper side wall and a lower side wall of the connector receiving main-part surrounding tips of the row of the connecting terminals; and a connector receiving auxiliary-part that is molded with a row of the connecting terminals after inserting the connecting terminals therein so that tips of the connecting terminals are not molded. The connector receiving auxiliary-part having the connecting terminals that is mounted from one of the mold extracting holes into the connector receiving main-part.

5 Claims, 5 Drawing Sheets

CONNECTOR CONNECTING DEVICE

BACKGROUND OF THE INVENTION

1. Field of the Invention

This invention relates to a connector connecting device having a plurality of rows of connecting terminals arranged so as to be place one above another.

2. Background

A connector connecting device of this type that is constructed as shown in FIG. 7 has heretofore been available. The connector connecting device shown in FIG. 7 has a plurality of rows of connecting terminals 1, 2 (only one connecting terminal per row is shown) arranged so as to be placed one above another in the vertical direction as viewed in FIG. 7. All the connecting terminals 1, 2 are inserted together to mold a connector receiving portion 3 that surrounds the tips 1*a*, 2*a* of these inserted connecting terminals 1, 2. A not shown connector is inserted into the connector receiving portion 3 so as to be connected.

FIG. 8 shows a mold used for molding the connector receiving portion 3. The mold includes: a lower mold 4, an upper mold 5, and an intermediate mold 6. Among those molds, the lower mold 4 serves to mold the bottom portion of the connector receiving portion 3, and is a fixed mold. On the other hand, the upper mold 5 serves to mold the top portion of the connector receiving portion 3, and is allowed to be opened upward as indicated by an arrow A. The intermediate mold 6 serves to mold the inner portion of the connector receiving portion 3, and is designed to be slid in such a horizontal direction as indicated by an arrow B (leftward as viewed in FIG. 8).

In the above example, the intermediate mold 6 molds the entire part of the inner portion of the connector receiving portion 3, the required sliding distance of the intermediate mold 6 is more than the total depth of the connector receiving portion 3, which makes the structure of the molds complicated and accordingly expensive.

In this example, slender holes 7, 8 are formed in the intermediate mold 6 so as to correspond to the connecting terminals 1, 2, so that the connecting terminals 1, 2 positioned and fixed to the lower mold 4 during mold alignment can be fitted into the slender holes 7, 8. However, it is extremely difficult to accurately align the holes with the terminals. With respect to the connecting terminal 1, in particular, which is bent at bending portions 1*b*, 1*c*, the degree of bending accuracy is not satisfactory. As a result, the positioning of the connecting terminals 1, 2 must be readjusted, which in turn leads to reduced productivity.

SUMMARY OF THE INVENTION

The present invention has been made in order to overcome the above problems and drawbacks, and an object of the invention is to provide a connector connecting device whose mold structure is simple and which can be manufactured with excellent productivity.

To achieve the above object, the invention is applied to a connector connecting device having a plurality of rows of connecting terminals arranged so as to be placed one upon another. The connector connecting device of the invention includes: a connector receiving main-part that is molded with a row of connecting terminals after inserting the connecting terminals therein, has mold extracting holes respectively formed in an upper side wall and a lower side wall of the connector receiving main-part surrounding tips of the row of the connecting terminals; and a connector receiving auxiliary-part that is molded with a row of the connecting terminals after inserting the connecting terminals therein so that tips of the connecting terminals are not molded. The connector receiving auxiliary-part having the connecting terminals that is mounted from one of the mold extracting holes into the connector receiving main-part.

According to the invention, the inside of the connector receiving main-part is molded not only by a intermediate mold slided therein but also by two molds extracted through the mold extracting holes. Hence, the sliding distance of the intermediate mold can be reduced as much as the molds extracted through the mold extracting holes.

Further, the intermediate mold which its sliding distance can be reduced, and the intermediate mold is not necessity to touch the connecting terminals. Therefore, it is not necessity to form the slender holes fitted with the connecting terminals, and it can be removed the cumbersome fitting operation.

Still further, with respect to the connector receiving auxiliary-part that is molded with a row of the connecting terminals after inserting the connecting terminals therein, there is no such restriction as having to place the connecting terminals one upon another, which in turn allows each row of connecting terminals to be molded independently and freely.

DETAILED DESCRIPTION OF THE PREFERRED EMBODIMENTS

A first embodiment of the invention will now be described with reference to FIGS. 1 to 5.

Figure 1:
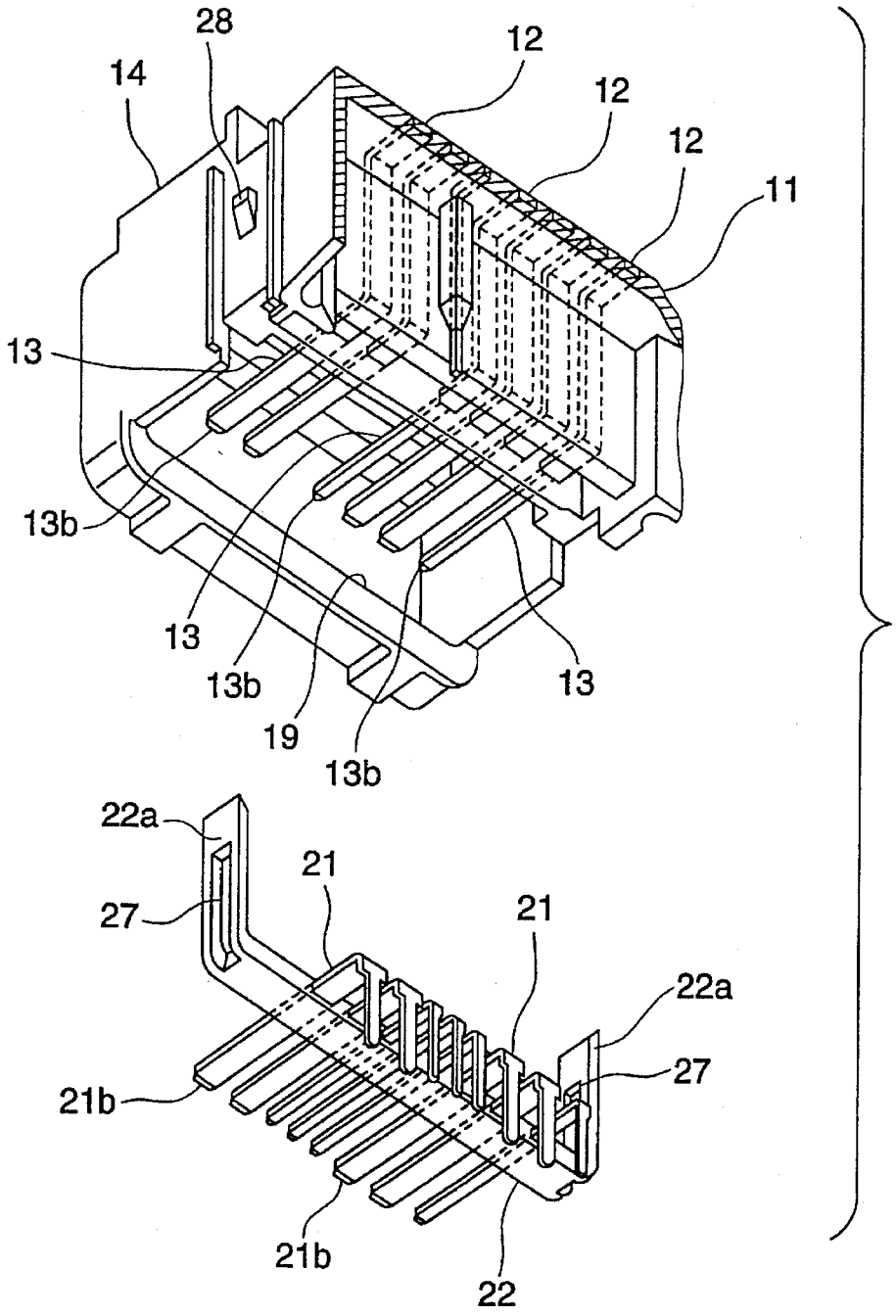
FIG. 1 is an exploded perspective view showing an embodiment of the invention.

FIG. 1 shows an insulator 11 used in switches for automobiles or the like. A predetermined conduction path (not shown in detail) is formed by burying conductors 12 so as to be coplanar with a surface of the insulator 11, the conductors 12 having been blanked from a metal plate.

Each end of the conductors 12 being on an opposite side to the insulator 11, is bent as connecting terminals 13 horizontally arranged in a row. A connector receiving main-part 14 is integrally molded with the connecting terminals 13 after inserting the connecting terminal thereinto.

Figure 2:
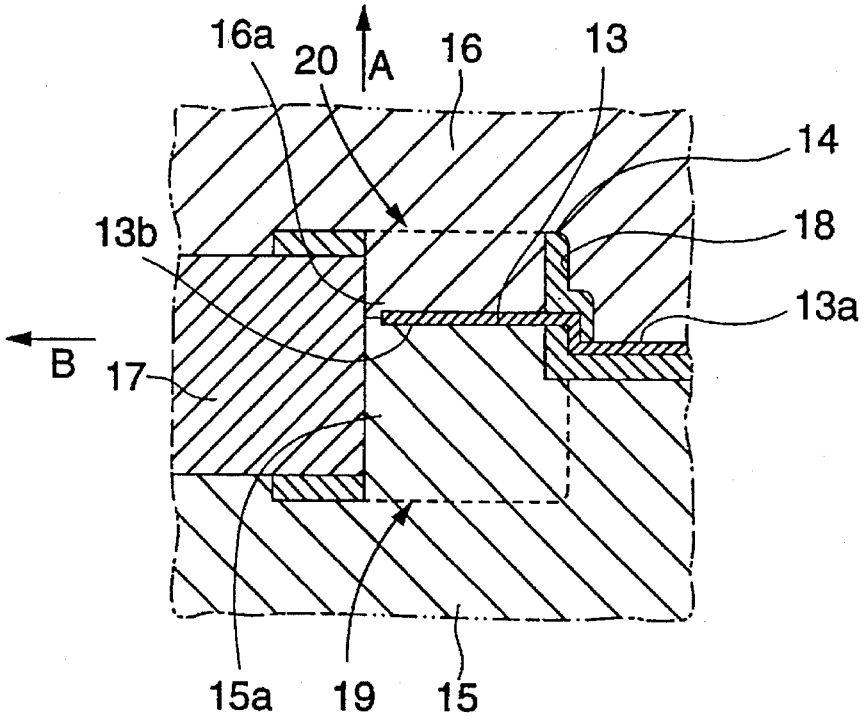
FIG. 2 is a sectional view of a mold for molding the connector receiving main-part.

FIG. 2 shows a mold for molding the connector receiving main-part 14. The mold includes a lower mold 15, an upper mold 16, and an intermediate mold 17. The lower mold 15 has a projecting portion 15*a* and molds an inner lower half in a lower side and a depth side of the connector receiving main-part 14. The lower mold 15 is a fixed mold. On the other hand, the upper mold 16 has a projecting portion 16*a* and molds an inner upper half in an upper side and a depth side of the connector receiving main-part 14. The upper mold 16 is opened upward as indicated by an arrow A. The intermediate mold 17 molds the inner portion on the entrance of the connector receiving main-part 14. The intermediate mold 17 is designed to be slidable in such a horizontal direction as indicated by an arrow B (leftward as viewed in FIG. 2). These molds form a cavity 18 for molding the connector receiving main-part 14. It should be noted that the lower mold 15 may be movable and that the upper mold 16 may be fixed, or that both may be movable.

Base portions 13*a* of the connecting terminals 13 are positioned within the cavity 18, the connecting terminals 13 are positioned and fixed on the lower mold 15. The connector receiving main-part 14 is molded by injecting molten synthetic resin into the cavity 18 and solidifying the injected molten resin. The connector receiving main-part 14 has a squared tubelike shape surrounding the row of tips 13*b* of the connecting terminals 13. By opening the mold, mold extracting holes 19, 20 are respectively formed in a lower side wall and an upper side wall extracted into the connector receiving main-part 14 by the projected portion 15*a* of the lower mold 15 and the projected portion 16*a* of the upper mold 16.

Connecting terminals 21 are also formed by punching and bending a metal plate. A connector receiving auxiliary-part 22 which is separated from the connector receiving main-part 14, is molded with the connector receiving terminals 21 after inserting the connecting terminals 21 in the connector receiving auxiliary-part 22 so horizontally as to arrange in a row.

Figure 3:
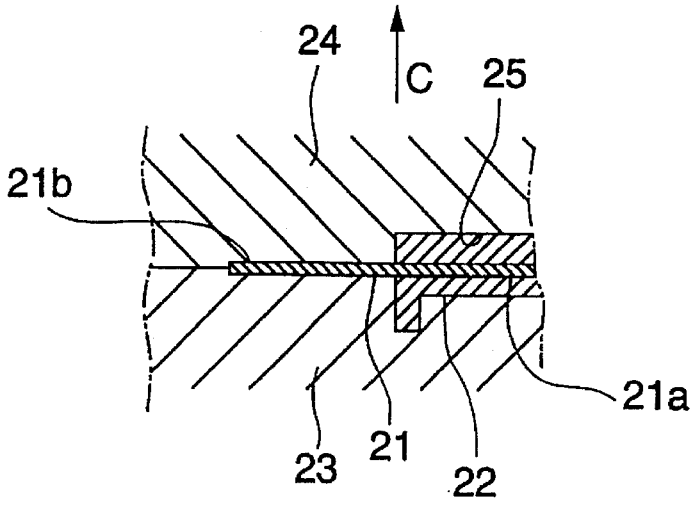
FIG. 3 is a sectional view of a mold for molding an connector receiving auxiliary-part.

FIG. 3 shows a mold for molding the connector receiving auxiliary-part 22. The mold includes a lower mold 23 and an upper mold 24. The lower mold 23 molds the bottom portion of the connector receiving auxiliary-part 22 and is a fixed mold. On the other hand, the upper mold 24 molds the top portion of the connector receiving auxiliary-part 22 and is designed to be opened upward as indicated by an arrow C. The lower mold and the upper mold form a cavity 25 for molding the connector receiving auxiliary-part 22. It should also be noted that the lower mold 23 may be movable and that the upper mold 24 may be fixed, or that both may be movable.

Figure 4:
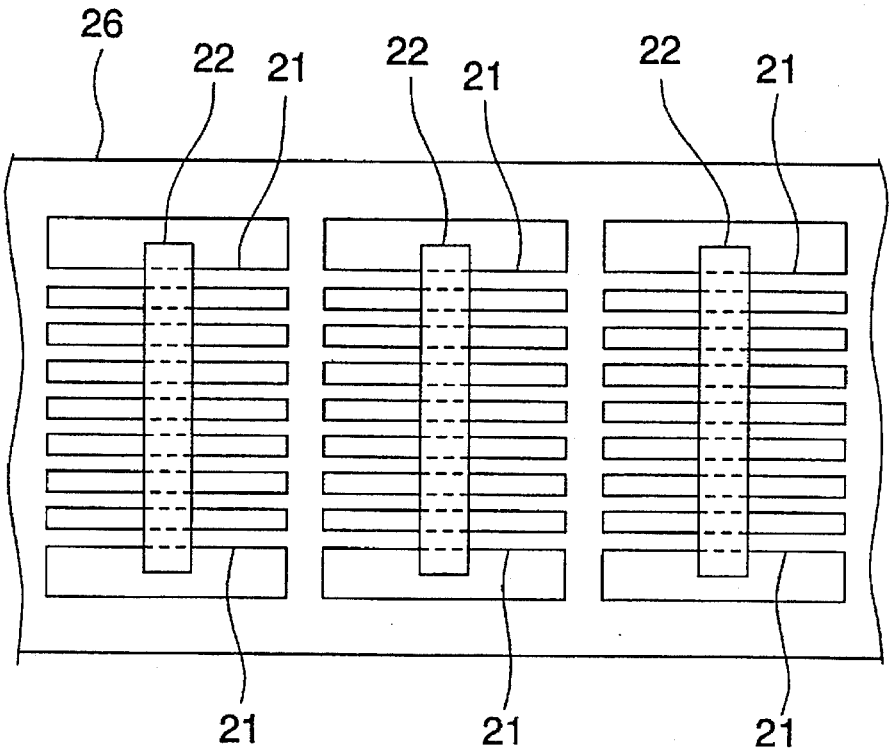
FIG. 4 is a plan view showing another embodiment of how the connector receiving auxiliary-part is molded.

Base portion 21*a* of the connecting terminals 21 are positioned within the cavity 25, the connecting terminals 21 are positioned and fixed on the lower mold 23. The connector receiving auxiliary-part 22 is molded by injecting molten synthetic resin into the cavity 25 and solidifying the injected molten resin. In this case, the following steps may be taken. The entire part of a plurality of sets of the connector receiving auxiliary-parts concatenated through a frame 26 shown in FIG. 4 is subjected to transfer molding or the like, and the individual connector receiving auxiliary-parts are thereafter bent and punched.

Figure 5:
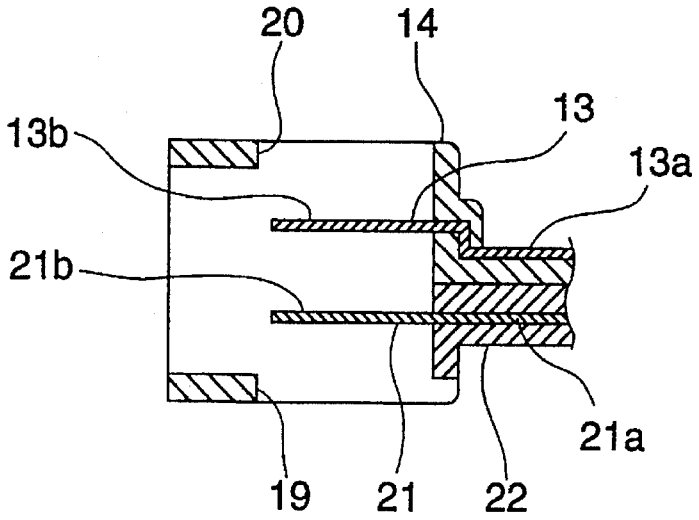
FIG. 5 is a sectional view of an assembled product.

Thus the molded connector receiving auxiliary-part 22 is beltlike with the row of tips 21*b* of the connecting terminals 21 not being enclosed. As shown in FIG. 1, the connector receiving auxiliary-part 22 has rising portions 22*a* on both ends thereof, and the rising portions 22*a* have the mounting holes 27, respectively. On the other hand, the connector receiving main-part 14 has claws 28 on both outer lateral surfaces thereof (only one claw is shown in FIG. 1). As shown in FIG. 5, the connector receiving auxiliary-part 22 having the connecting terminals 21 is mounted from the mold extracting hole 19 into the connector receiving main-part 14 to engage the claws 28 with the mounting holes 27, so that the connector receiving auxiliary-part 22 is coupled to the connector receiving main-part 14 to have the connecting terminals 13 placed above the connecting terminals 21.

According to the aforementioned construction, the inside of the connector receiving main-part 14 is molded not only by the intermediate mold 17 slided therein, but also the projected portions 15*a*, 16*a* of the lower and the upper molds 15, 16 that are the molds to be extracted through the mold extracting holes 19, 20. The sliding distance of the intermediate mold 17 can be reduced as much as the projected portions 15*a*, 16*a* of the lower and upper molds 15, 16 to be extracted through the mold extracting holes 19, 20. Hence, the mold structure can be accordingly simplified which in turn contributes to cost reduction.

Further, the intermediate mold 17 which its sliding distance can be reduced, and the intermediate mold 17 is no necessity to touch the connecting terminals 13. Therefore, it is no necessity to form the slender holes into which the connecting terminals 13 are fitted, thereby it can be removed the cumbersome operation of fitting the connecting terminals into the slender holes. As a result, positioning adjustment and the like of the connecting terminals 13 to fit them into the slender holes can likewise be removed, which hence contributes to improving productivity.

Still further, the connector receiving auxiliary-part 22 that is molded with a row of the connecting terminals 21 after inserting the connecting terminals 21 therein, there is no such restriction as placing the connecting terminals 21 under the connecting terminals 13, thereby allowing independent and free molding. Hence, further improved productivity can be provided.

Figure 6:
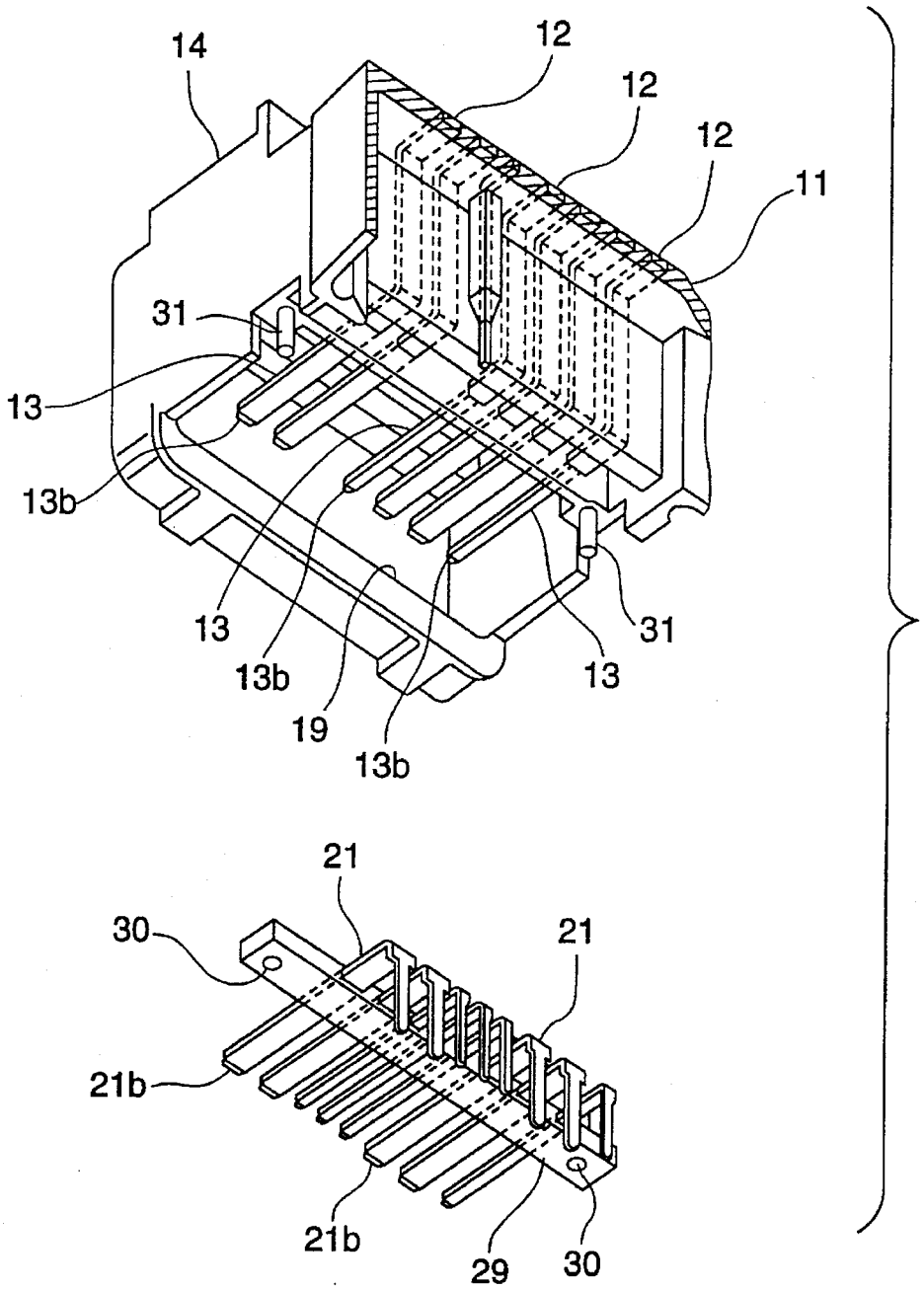
FIG. 6 is a diagram equivalent of FIG. 1 showing another embodiment of the invention.
Figure 7:
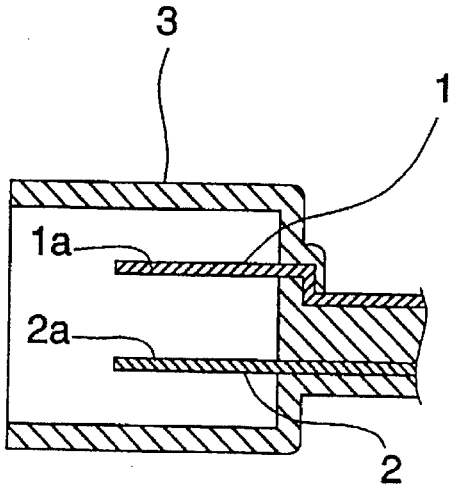
FIG. 7 PRIOR ART
FIG. 7 is a sectional view of an assembled product of a conventional connector.
Figure 8:
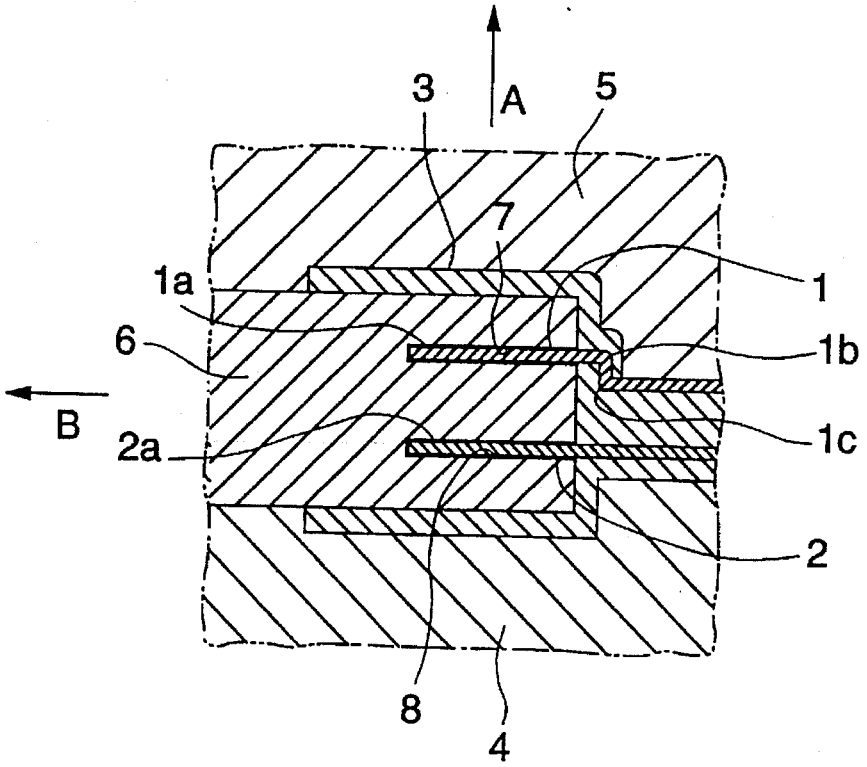
FIG. 8 PRIOR ART
FIG. 8 is a sectional view of a mold for molding the conventional connector of FIG. 7.

In contradistinction with the foregoing, FIG. 6 shows a second embodiment of the invention. This embodiment is characterized as: not only forming mounting holes 30 into both end portions of a connector receiving auxiliary-part 29 which replaces the above-mentioned connector receiving auxiliary-part 22 but also forming pinlike projections 31 downward on both edges of bottom surface of the connector receiving main-part 14 to thereby fitting the projections 31 into the mounting holes 30; and welding the projecting tip portions of the projections 31 by heating to thereby couple the connector receiving auxiliary-part 29 to the connector receiving main-part 14.

This embodiment can also provide the advantage similar to that provided by the aforementioned embodiment. It may also be proposed that a mounting structure in which the projections 31 are fitted into the mounting holes 30 be supplemented by the aforementioned mounting structure in which claws 28 are engaged with the mounting holes 27.

While the two-row connecting terminal construction with the connecting terminals 13, 21 has been described in the aforementioned embodiments, the number of rows may be increased to three, four, and so on by molding the connector receiving auxiliary-part while inserting the connecting terminals on a single row basis and coupling the thus molded connector receiving auxiliary-part to the connector receiving main-part.

The invention is not limited to the embodiments described above and shown in the drawings, but may be embodied while appropriately modified within the scope and spirit of the invention.

As is apparent from the foregoing description, the connector connecting device of the invention is characterized as follows. The connector connecting device has a plurality of rows of connecting terminals arranged so as to be placed one upon another, and includes: a connector receiving main-part that is molded with a row of connecting terminals after inserting the connecting terminals therein, has mold extracting holes respectively formed in an upper side wall and a lower side wall of the connector receiving main-part surrounding tips of the row of the connecting terminals; and a connector receiving auxiliary-part that is molded with a row of the connecting terminals after inserting the connecting terminals therein so that tips of the connecting terminals are not molded. The connector receiving auxiliary-part having the connecting terminals that is mounted from one of the mold extracting holes into the connector receiving main-part.

What is claimed is:

1. A connector, comprising:

a housing;

a connector receiving chamber formed on said housing, said connector receiving chamber having a row of terminals;

mold extracting holes for extracting molds molding an inside of said connector receiving chamber, said mold extracting holes being formed in an upper side wall and a lower side wall of said connector receiving chamber, respectively;

an auxiliary part separately formed on said housing, said auxiliary part having a row of terminals; and mounting means for retaining said auxiliary part in said connector receiving chamber.

2. The connector of claim 1, wherein said connector receiving chamber and the row of the terminals are integrally molded.

3. The connector of claim 1, wherein said auxiliary part and the row of the terminals are integrally molded.

4. The connector of claim 1, wherein said mounting means includes claws formed on opposite sides of said connector receiving chamber and mounting holes formed in said auxiliary part to engage with said claws.

5. The connector of claim 1, wherein said mounting means includes projections projected downward from said connector receiving chamber and mounting holes formed in both ends of said auxiliary part to engage with said claws.

* * * * *